US006200027B1

(12) United States Patent
Jones

(10) Patent No.: US 6,200,027 B1
(45) Date of Patent: Mar. 13, 2001

(54) FLEXIBLE FILM WASHING AND DEWATERING DEVICE FOR FOOD ITEMS

(76) Inventor: Darlene N. Jones, 842 William St., River Forest, IL (US) 60305

( * ) Notice: Subject to any disclaimer, the term of this patent is extended or adjusted under 35 U.S.C. 154(b) by 0 days.

(21) Appl. No.: 09/502,141

(22) Filed: Feb. 11, 2000

Related U.S. Application Data

(60) Provisional application No. 60/119,813, filed on Feb. 12, 1999, now abandoned.

(51) Int. Cl.[7] ..... B65D 30/22

(52) U.S. Cl. ..... 383/40; 383/63; 383/64; 383/67; 383/100; 210/464

(58) Field of Search ..... 383/63, 64, 38, 383/40, 67, 100, 103, 65; 24/587, 400, 389; 210/464, 466

(56) References Cited

U.S. PATENT DOCUMENTS 2,163,324 * 6/1939 Reinhold ..... 210/464 X
3,159,096 * 12/1964 Tocker ..... 383/103
4,715,963 12/1987 Jones .
4,834,554 * 5/1989 Stetler, Jr. et al. ..... 383/100
5,380,093 1/1995 Goldman .
5,442,837 * 8/1995 Morgan ..... 24/587 X
5,851,070 * 12/1998 Dobreski et al. ..... 383/63

FOREIGN PATENT DOCUMENTS

2224356 * 10/1974 (FR) ..... 383/100
139552 * 5/1990 (JP) ..... 383/100

* cited by examiner

*Primary Examiner*—Stephen K. Cronin
*Assistant Examiner*—Robin A. Hylton
(74) *Attorney, Agent, or Firm*—Fitch, Even, Tabin & Flannery

(57) ABSTRACT

A bag formed of flexible thinwall sheet material for washing and/or dewatering comestibles having an upper compartment and a lower compartment connected by at least one opening. The bottom of the lower compartment is formed by a zipper-type closure. The members of the closure resist separation under elevated hydrostatic pressure generated in the lower compartment by centrifugal force. The closure may include a slider for providing controlled engagement and disengagement of the members, to permit use of the bag both for washing and dewatering.

5 Claims, 1 Drawing Sheet

FLEXIBLE FILM WASHING AND DEWATERING DEVICE FOR FOOD ITEMS

RELATED APPLICATION

This application is based on, and claims benefit of, U.S. Provisional application Ser. No. 60/119,813, filed on Feb. 12, 1999now abandoned.

The present invention relates generally to articles for food preparation and, more particularly, to an article for washing and/or removing excess liquid from the surface of comestibles such as salad greens.

BACKGROUND OF THE INVENTION

Many comestibles need to be washed prior to serving to remove undesired sand, grit, etc. Typical are salad greens, and the present invention will be described in connection therewith, although it should be understood that it may also be used with a variety of fruits and vegetables, either whole, sliced or diced. Washing of salad greens is usually done by rinsing the greens with running water. After washing, it is usually necessary to remove the excess water remaining on the surface of the greens. The retained water is difficult to remove, being held tenaciously on the surface of the greens. Various means are employed to remove the adhering water, including manually shaking the greens, or placing the greens on absorbent paper or cloth to remove the liquid by capillary action. Both methods of removal have shortcomings; shaking the greens tends to broadcast water in all directions, and absorbing the water is time consuming and requires substantial counter space and a large amount of absorbent paper or cloth.

Another situation in which it is desirable to remove excess liquid from salad greens is after dressing has been added to the greens. Frequently, an amount of dressing is added in excess of that necessary in the finished salad, in order to ensure that the dressing will coat most of the greens. In such instances, it is desirable to remove the excess liquid to avoid oversaturation and unsightliness due to the excess liquid. The same difficulties are encountered in removing the excess liquid as already described.

THE PRIOR ART

To overcome these difficulties, various mechanical devices have been devised to wash and/or remove the excess water. Mechanical devices for this purpose typically include a perforated bowl for receiving the greens, the bowl being rotatably received in an outer stationary bowl. The greens in the inner bowl are rinsed with water, following which the inner bowl is spun to impel the excess water from the greens through the perforations and into the outer bowl. Such mechanical devices are costly, cumbersome to use, take up a large amount of storage space between uses, and require cleaning and drying after each use.

U.S. Letter Pat. No. 4,715,963 discloses a simple and inexpensive means for dewatering salad greens. The article disclosed in that patent is a bag formed of thin walled sheet material having an upper compartment and a lower compartment separated by a seal which extends across most of the bag, but is discontinuous in at least one region so as to provide an opening between the upper compartment and the lower compartment. Washed salad greens are placed in the upper compartment, after which the bag is manually twirled so that, under the influence of centrifugal force, the surface water is impelled from the salad greens against the heat seal line separating the compartments, and thence through the opening or openings into the lower compartment. The water removed from the salad greens is collected in the lower compartment, where it remains until the dewatered salad greens are removed from the upper compartment. The bag is then disposed of, either with the water still in place in the lower compartment or, if desired, the water may first be drained from the lower compartment by cutting open the bag, after which the bag is discarded.

The dewatering method and device of the '963 patent perform commendably, and provide an exceedingly convenient and inexpensive solution to the problem of dewatering salad greens and other comestibles. One disadvantage is that the device is designed for a single use, after which the bag is discarded. Inasmuch as the bag is made of inexpensive plastic film, and produced economically, this is entirely feasible. Nevertheless, it would be desirable to provide a similarly convenient and inexpensive article which would be suitable for multiple use.

Another disadvantage of the '963 method and device is that they are not readily adapted for washing salad greens. The amount of water needed for adequate removal of foreign material is substantial, and ordinarily would exceed the volumetric capacity of the lower compartment.

Another type of bag designed for use in dewatering salad greens in accordance with the method of the 1963 patent is disclosed in U.S. Pat. No. 5,380,093. In accordance with the '093 patent, washed salad greens are placed in an upper compartment, and the bag is revolved to drive water into a lower compartment through a plurality of holes. After collecting in the lower compartment, the water may be poured out through a channel extending along the side of the bag from the lower compartment to the top of the bag. The bag is thereafter used for refrigerated storage of the washed salad greens. There is no teaching in the '093 patent that the bag may be reused and, indeed, the patent teaches that the bag is disposable. Moreover, the bag of the '093 patent has dead spots in the lower compartment and in the side channel which are not susceptible to effective sanitization between uses, and which can harbor undesired microorganisms and lead to their proliferation. Neither is the '093 bag adapted for use in washing greens, inasmuch as the lower compartment would quickly fill with wash water.

It is a principal object of the present invention to provide a dewatering device for washing and/or removing excess liquid from salad greens and other comestibles which overcomes the described problems. It is a further object of the present invention to provide a bag formed from flexible film which performs as a washing and dewatering device and which is readily reusable. It is a more specific object of the present invention to provide a washing and dewatering bag formed from flexible film which is adapted to be readily sanitized after use. These and other objects will be apparent from the following description and drawing.

SUMMARY OF THE INVENTION

In accordance with the present invention, there is provided an improved washing and dewatering device for comestibles, formed from flexible thinwall film, which is capable of substantial reuse. The article may be thoroughly cleansed between uses, with substantially no dead spaces where undesired microorganisms may accumulate. Even so, the dewatering device is relatively inexpensive, and retains all of the other advantages of the dewatering method and device disclosed in the '963 patent.

Briefly, the dewatering bag of the present invention comprises a bag formed of thermoplastic thinwall sheet material divided into a first, upper compartment, and a second, lower compartment. The upper compartment is adapted to receive food items, such as salad greens, and has an open top to enable their insertion. The upper compartment is separated from the lower compartment by a discontinuous weld line, the discontinuity being such as to form at least one throat sized to permit passage of water therethrough, but substantially to prevent passage of the washed salad greens. The lower compartment is designed to function as a temporary storage space for wash water impelled from the salad greens placed in the upper compartment. The bag is used to dewater the greens by grasping the open end of the upper compartment and revolving, spinning or twirling the dewatering bag from the open end. Radial acceleration generated by revolving the bag and its contents results in the imposition of radial forces on water droplets, impelling them from the greens and thence through the throat and into the lower compartment.

An important feature of the present invention is means by which water collected in the lower compartment is selectively releasable therefrom, and by which the lower compartment may be sanitized after use so that the dewatering bag may be reused one or more times. Alternatively, if desired, the dewatering bag is sufficiently inexpensive that it may be discarded after a single use.

This feature is enabled by the surprising discovery that the bottom of the lower compartment may be formed in whole or in part by an openable longitudinal fastening means formed from two interlocking components, commonly known as a zipper-type fastener. The provision of a zipper fastener at this site has not heretofore been suggested or taught, no doubt because it was not appreciated that a zipper fastener can withstand the elevated "g" forces generated by revolving the bag without parting. For example, the '093 patent referred to above discloses the use of a releasable locking strip such as sold under the brand name "ZIPLOC®" to seal the top of the upper compartment, but that site is not subjected to elevated "g" forces. The '093 patent clearly does not teach or suggest the use of a zipper fastener to seal the bottom compartment.

The provision of a zipper fastener forming the bottom of the lower compartment permits draining and washing of the lower compartment after use to sanitize it and thereby inhibit growth of undesired microorganisms. In a more preferred embodiment, the fastener is provided with a slider to enable controlled opening of the zipper for only a portion of its length, so that collected water may be drained through a bottom corner of the lower compartment. The zipper may thereafter be reclosed, to permit additional water to be collected in the lower compartment. This enables the volume of the lower compartment to be minimized with respect to the volume of the upper compartment thereby decreasing the overall dimensions of the bag.

In a most preferred embodiment, the bag is used as a receptacle for washing the greens prior to dewatering. In this embodiment, the slider of the zipper is positioned so as to fully open the bottom compartment so that it acts as a sleeve to guide wash water flowing by gravity from the upper compartment. After the greens are thoroughly washed, the slider is moved to closed position, whereupon the dewatering function described above may be performed.

DESCRIPTION OF THE PREFERRED EMBODIMENTS

Figure 1:
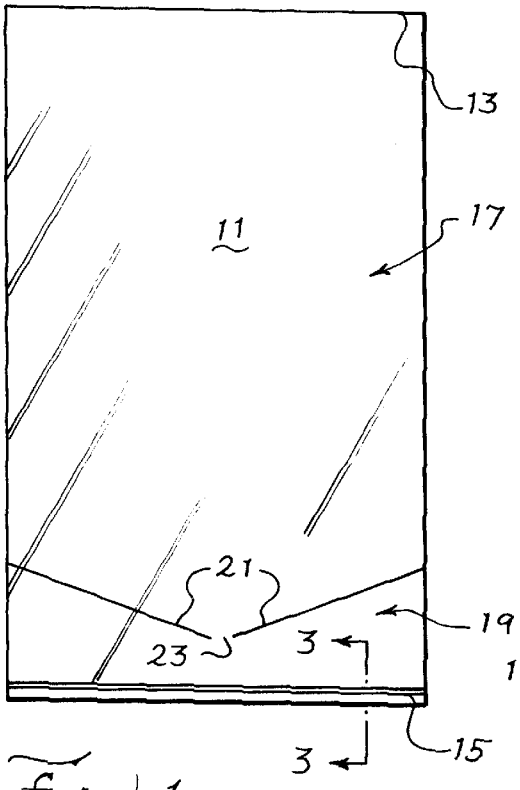
FIG. 1 is a plan view of a first embodiment of a flexible film dewatering bag constructed in accordance with the present invention.

Referring now to FIG. 1, a bag 11 is provided having an open top 13 and a bottom closure 15. The bag is made from a thin-walled thermoplastic material such as low density or high density polyethylene. The bag 11 is divided into an upper compartment 17 and a lower compartment 19 by a discontinuous weld line 21, the discontinuity providing at least one throat or opening 23. In the illustrated embodiment, the weld line 21 is vee-shaped, with a single throat 23 at the point of the vee and generally at the centerline of the bag. It should be understood that the weld line may be discontinuous at a plurality of locations to provide a plurality of throats, and that the illustrated embodiment constitutes only one weld line embodiment.

The closure 15, defining the bottom of the lower compartment 19, comprises a continuous zipper-type closure having a female element 25 (FIG. 3) and a male element 27 interlocking with the female element. The female element 25 is welded to the front wall of the bag 11 and includes a lip 29 extending downwardly from the lower compartment. The male element 27 is welded to the back wall of the bag 11 and includes a lip 31 which extends under and around lip 29 of the female element.

This configuration of the interlocking lips of the male element 27 and the female element 25 resists separation of the elements even under the elevated hydrostatic pressure conditions generated in the lower compartment when the bag and its contents are vigorously twirled or revolved. This is a feature not disclosed or suggested in the prior art.

When the lower compartment becomes partially or fully charged with liquid removed from the food items in the upper compartment, the closure 15 may nevertheless readily be opened by grasping the male and female elements below the closure and pulling them apart. The lips are readily separable when manipulated from the underside of the closure 15, and the liquid contained in the lower compartment may be drained away through the opened closure. The elements may thereafter be re-engaged by pressing them together with finger pressure, enabling dewatering to be resumed if not yet complete.

Figure 3:
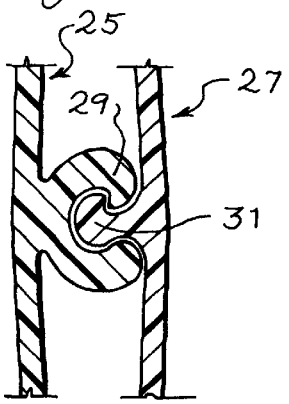
FIG. 3 is an enlarged fragmentary cross-sectional view taken along lines 3—3 of FIG. 1.

Upon completion of dewatering, the closure 15 may be fully opened, making the bottom compartment 19 completely accessible for cleaning and sanitization so that the bag may be used again at a later time. Closures suitable for the embodiment of FIGS. 1 and 3 are commercially available in polyethylene bags sold under the brand name "ZIPLOC®" by S.C. Johnson and Co., Racine, Wis.

Figure 2:
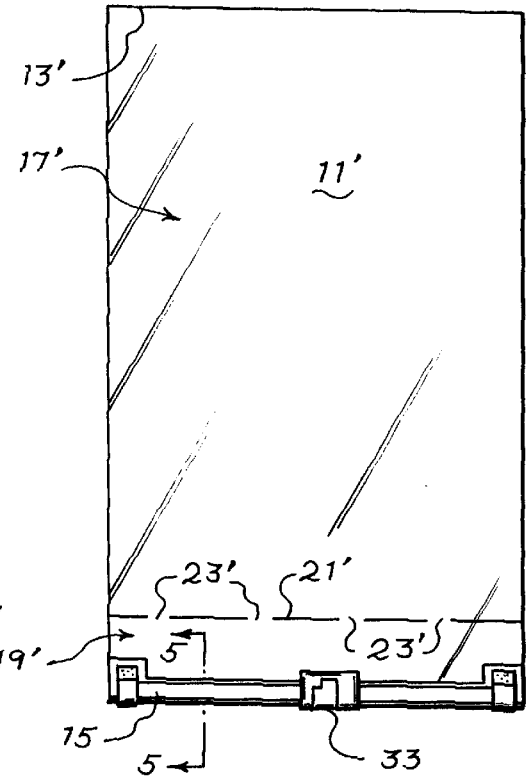
FIG. 2 is a plan view of a second embodiment of a flexible film dewatering bag also constructed in accordance with the present invention.
Figure 4:
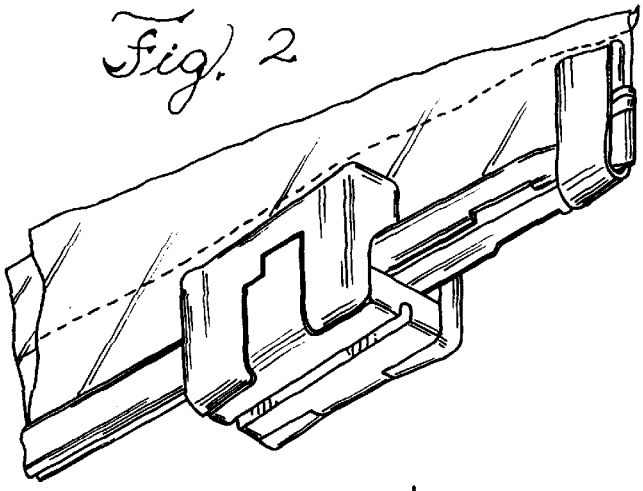
FIG. 4 is an enlarged fragmentary perspective view of the lower right hand corner of the dewatering bag of FIG. 2.
Figure 5:
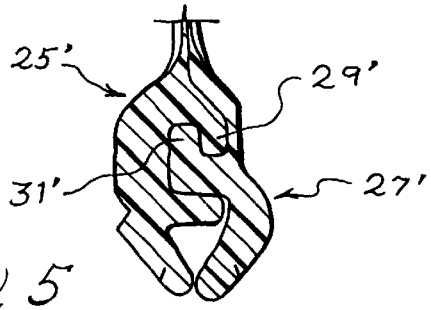
FIG. 5 is an enlarged fragmentary cross-sectional view taken along lines 5—5 of FIG. 2.

A preferred embodiment of the bag of the present invention is shown in FIGS. 2, 4 and 5, in which the same reference numerals are used with a "prime" symbol to identify components corresponding or analogous to those of FIGS. 1 and 3. A bag 11' is provided having an open top 13' and a bottom closure 15'. The bag 11' is divided into an upper compartment 17' and a lower compartment 19' by a discontinuous weld line 21', and in the illustrated embodiment, the weld line 21' is discontinuous in four regions to provide four throats or openings 23'.

The closure 15', defining the bottom of the lower compartment 19', comprises a continuous zipper-type closure having a female element 25' (FIG. 5) and a male element 27' interlocking with the female element. The female element is welded to the front wall of the bag 11' and includes a lip 29' extending downwardly from the lower compartment 19'. The male element 27' is welded to the rear wall of the bag 11, and includes a lip 31' which extends under and around the lip 29 of the female element.

As in the embodiment of FIGS. 1 and 3, the configuration of the matching lips of the male element 27' and the female element 25' resists separation of the elements under the elevated hydrostatic pressure conditions generated in the lower compartment 19' during dewatering use. The closure also provides the other benefits and advantages described in connection with the embodiment of FIGS. 1 and 3.

A further important feature of the embodiment of FIGS. 2, 4 and 5 is the provision of a slider 33 straddling the interlocking male and female elements 25' and 27' which permits precisely limited separation thereof. The slider 33 is of the type illustrated in U.S. Pat. No. 5,161,286, which is incorporated herein by reference.

When the lower compartment 19' becomes charged with liquid removed from food items in the upper compartment, the closure may be partially opened by sliding the slider to a position away from the end stop (shown in two different positions in FIGS. 2 and 4), and the liquid drained away through the resultant gap. Because the slider enables rapid and precise opening and reclosing of the closure, draining can be effected several times during the course of dewatering and this, in turn, permits the volume of the bottom compartment to be substantially less than if it were sized so as to hold all of the liquid to be removed. For example, the volume of the bottom compartment may comprise as little as ten percent or less than that of the upper compartment.

Bags with closures suitable for the embodiment of FIGS. 2, 4 and 5 are exemplified by those available under the previously mentioned ZIPLOC® brand name, as well as under the brand name HEFTY ONE ZIP® from Tenneco Packaging, Pittsford, N.Y.

A further feature of the present invention is the capability of the bag 11 or 11' to be used as a device for washing salad greens as well as dewatering after washing. By fully opening the closures 15 and 151, the lower compartments 19 and 191 become sleeves through which wash water may freely pass. Thus, unwashed salad greens may be placed in the upper compartments 17 and 17', and running water may be introduced through the open tops 13 and 13'. The greens may be manipulated under the running water, with the wash water running freely through the openings 23 and 231 and thence to a sink drain. After washing, the closures 15 and 15' are closed, and the washed greens dewatered by twirling the bag as described above.

As various changes could be made in the above constructions without departing from the scope of the invention, it is intended that all matter contained in the above description should be interpreted as solely illustrative and not in a limiting sense.

What is claimed is:

1. A bag formed from flexible thinwall sheet material for dewatering comestibles by use of centrifugal force, comprising:

an upper compartment having an unsealed open top and defined by a front wall, a back wall and a bottom formed by a discontinuous weld line joining said walls to provide one or more throats for passage of water therethrough, and a lower compartment defined by a front wall, a back wall, said discontinuous weld line, and a selectively openable and reclosable bottom closure, said discontinuous weld line disposed between said upper compartment and said lower compartment, said closure comprising two substantially continuous zipper type elements including a female element and an interlocking male element, whereby said closure resists separation under the elevated hydrostatic pressure generated in said lower compartment by the centrifugal force of dewatering.

2. A bag in accordance with claim 1 further comprising a slider embracing said male and female elements to effect controlled engagement and disengagement thereof.

3. A bag in accordance with claim 1 wherein said bottom closure is substantially fully openable to permit unrestricted passage of water from said lower compartment, enabling said bag to be used for washing comestibles prior to dewatering.

4. A bag in accordance with claim 1 wherein said female element has a lip extending downwardly from said bottom compartment in facing relation to said male element, and wherein said male element has a lip extending upwardly toward said bottom compartment shaped to be received under and around the downwardly extending lip of said female element.

5. A bag in accordance with claim 1 wherein the volume of said lower compartment is no more than about ten percent of the volume of said upper compartment.

* * * * *